United States Patent [19]

Dämmig et al.

[11] Patent Number: 4,475,426

[45] Date of Patent: Oct. 9, 1984

[54] APPARATUS FOR SUPPLYING CHEWING GUM TO A PACKAGING MACHINE

[75] Inventors: Werner Dämmig, Fürth; Heinz Möller, Eggolsheim, both of Fed. Rep. of Germany

[73] Assignee: "LOESCH"-Verpackungstechnik GmbH & Co KG, Forchheim, Fed. Rep. of Germany

[21] Appl. No.: 373,177

[22] Filed: Apr. 29, 1982

[51] Int. Cl.[3] ..... B26D 3/08; B26D 7/32

[52] U.S. Cl. ..... 83/887; 83/155.1; 83/281; 83/400; 83/648; 83/734; 83/864; 83/925 R; 83/514

[58] Field of Search ..... 83/887, 864, 648, 734, 83/926, 925, 404.1, 404.2, 155, 155.1, 281, 399, 400; 53/514

[56] References Cited

U.S. PATENT DOCUMENTS 2,931,151 4/1960 Simeone et al. .

3,915,039 10/1975 Schoppee ..... 83/864

3,933,064 1/1976 Schoppee .

*Primary Examiner*—Donald R. Schran

*Attorney, Agent, or Firm*—Cushman, Darby & Cushman

[57] ABSTRACT

The apparatus for supplying chewing gum along a path to the driven feeder of a packaging machine includes a magazine, a scoring device, a pushing device for advancing chewing gum slabs from the magazine to the scoring device and a transfer device for advancing the scored gum slabs from the scoring device to the driven feeder. The pushing device and feeder are driven in relation to one another; however the scoring device and transfer device are driven at a constant speed which is independent of the operating rate of the pushing device and feeder. As a result, the chewing gum slabs are delivered to the feeder at the same speed under all operating conditions and will not become caught, deformed or piled-up in the apparatus due to changes in the operating rate of the feeder.

5 Claims, 3 Drawing Figures

APPARATUS FOR SUPPLYING CHEWING GUM TO A PACKAGING MACHINE

BACKGROUND OF THE INVENTION

This invention relates to apparatus for supplying chewing gum to a packaging machine.

Such apparatus is generally known from U.S. Pat. No. 3,933,064 and is intended to ensure a continuous transportation of the chewing gum slabs at all operating speeds of the packaging machine. For this purpose the transfer means includes a reciprocable pusher, a scoring means (cutter rollers) and means for driving the pusher in timed relation to a feeder. The main drive comprises a crankshaft for driving the ejecting pusher of the pushing device from the packaging machine with a speed reduction corresponding to the number of chewing gum sticks to be obtained from each chewing gum slab. That timed relation between the parts of the apparatus is intended to ensure continuous transportation of the chewing gum slabs at all operating speeds of the packaging machine, even when the machine is driven by a handwheel. In that way it is intended to avoid the risk of a seizing or accumulation of chewing gum slabs between the transfer device and the feeder.

A disadvantage of that apparatus resides in that the chewing gum slabs move along a non-planar path from the scoring means (cutter rollers) to the feeder. As the feeder includes of link chains and the frictional coupling required for the conveyance of the chewing gum slabs cannot be ensured unless the link chains are disposed on a distinctly higher level than a bottom plate that is disposed between and beside the link chains, there is a risk that the chewing gum slabs may strike against the link chains and be deformed by the latter. This will occur particularly if the chewing gum slabs are transferred to the feeder too quickly or too slowly, when the packaging machine operates at different speeds which deviate from an optimum speed.

Another disadvantage of the known apparatus resides in that the chewing gum slabs abut with their ends as they are conveyed behind the cutter rollers of the scoring means. This fact renders the operation less reliable where high-duty packaging machines are employed because the chewing gum slabs have a very small thickness so that the chewing gum slabs may slide one over the other. Unreliable conditions are usually obtained during a standstill, a starting or a slowing down of the machine or when the machine is intermittently driven by a handwheel, because in such cases the chewing gum slabs may remain in an undefined position in which they are inclined on a step in the path of conveyance between the cutter rollers and the feeder. The pivoted lever for operating the pusher for transferring the slabs between the cutter rollers and the feeder may also be arrested in an undefined position so that this lever may not reliably and satisfactorily carry a chewing gum slab along during the next stroke and this may result in malfunctioning.

In another apparatus, known from U.S. Pat. No. 2,931,151, transfer means is provided between scoring means, which includes cutter rollers, and a feeder which includes feed rollers which are continuously driven jointly with the cutter rollers. In that apparatus a photoelectric light barrier is provided on the feeder which leads to the packaging machine. The light barrier detects the end of each chewing gum slab and actuates a single-revolution clutch for driving the pushing device so that the next chewing gum slab is ejected from the magazine and delivered to the feeder. The photoelectric light barrier and the single-revolution clutch are not operatively connected to the packaging machine.

A disadvantage of that known apparatus resides in that the chewing gum slabs have a large spacing on the feeder because the feeding of the next chewing gum slab will not be initiated until the preceding one has been completely processed. As the feeder can have only a limited length in practice, the slab cannot catch up on the feeder; for this reason the known apparatus is suitable only for relatively small supply rates. The succeeding chewing gum slab must adjoin the preceding slab without a gap before it enters the receiving mechanism of the packaging machine (breaker).

Another disadvantage of the known apparatus resides in that it is not possible reliably to deliver the chewing gum slabs to the feeder under all operating conditions, for instance, when the machine is running-up from a standstill or slowing down to a standstill or is intermittently operated by hand.

In view of said last-mentioned known apparatus comprising feed rollers or transfer rollers between the cutter rollers and the feeder, it has been stated in the above-mentioned U.S. Pat. No. 3,933,064 that the feed rollers or transfer rollers will not reach a sufficiently high speed for a proper pushing of the chewing gum slabs when the packaging machine is driven at a varying speed or is manually operated and that this will cause chewing gum slabs to be seized or to accumulate between the feed rollers and the feeder. It has also been stated in said patent that said problem could be eliminated to a certain degree if a separate motor is provided for driving the transfer rollers or feed rollers always at a constant speed. But as the speed of the feeder will vary with the operating speed of the packaging machine, it will not be possible under these conditions to maintain a properly timed relation between the independently driven transfer rollers or feed rollers and the feeder.

SUMMARY OF THE INVENTION

An object of this invention is based on recognition that the above-mentioned that is apparent from U.S. Pat. No. 3,933,064 can be overcome and resides in that satisfactory transfer of the chewing gum slabs to the feeder is ensured under widely varying operating conditions of the packaging machine although transfer rollers or feed rollers are provided between the scoring means and the feeder.

Whereas the timed relation between the pushing device and the feeder is maintained, as is taught by U.S. Pat. No. 3,933,064, the timed relation between the motions of the scoring means and the transfer means, on the one hand, and the feeder, on the other hand, which is also taught by said prior patent, is not used, and, instead, the scoring means (cutter rollers) and, the transfer means (feed rollers) are driven at a constant speed which is independent of the speeds of the packaging machine and of the feeder. As a result, the chewing gum slabs will always be delivered to the feeder at the same speed under all operating conditions of the packaging machine so that they cannot be caught or deformed or pile-up. This ensures that the chewing gum slabs will always reach the feeder under the same conditions and that their speed will always be so high that they will be thrown with an adequate momentum across the conveying means of the feeder and that the chewing gum slabs will nevertheless be so gently handled that they will not be subjected to influences which would disturb the further processing. Because the feed rollers drive at constant speed continue to rotate also when the packaging machine has stopped, that boundary condition will also be coped with, different from the known apparatus, and no chewing gum slabs can be caught in the path leading to the feeder.

In conjunction with packaging machines operating at very high speeds (for packaging about 1500 chewing gum sticks per minute), changes in operating conditions of the packaging machine will necessitate an adjustment of speed. Such changes in operating conditions may be necessitated by fluctuations in the properties of the chewing gum sticks or of the packaging medium or in preparing or setting the machine for work. For instance, when the speed of the packaging machine is increased, the feeding speed of the feeder will be increased too and each chewing gum slab will be processed within a shorter time. On the other hand, the transfer of the chewing gum slabs from the cutter rollers to the feed rollers will always take the same time as these rollers operate at a constant speed of conveyance so that an acceleration of the feeder will have the result that the arrival of the next chewing gum slab on the feeder will be belated. To ensure that the next following chewing gum slab will arrive on the feeder in time and will adjoin the preceding slab, the phase-shifting means provided according to the invention will advance the time at which the slab is ejected by the pushing device.

For this purpose, the pushing device is shifted in phase in accordance with the change of the speed of the packaging machine whereas the fixed transmission ratio between the packaging machine and the pushing device is not changed. That ratio depends on the number of chewing gum sticks to be obtained from a chewing gum slab.

The means for phase shifting may comprise a differential, which may be included in the mechanism that is connected to the packaging machine and drives the pushing devide. The extent to which the differential is adjusted may be controlled by a speed selector associated with the packaging machine.

The means for phase shifting may comprise a two-motor drive. When a speed selector causes a change of the speed of the packaging machine, an angle-of-rotation comparator and a controller act to effect a phase shift of the motor for driving the pushing device.

Other means for shifting a drive in phase are well known to a person skilled in the art and may be used within the scope of the invention.

An illustrative embodiment of the invention will now be described with reference to the drawings.

DETAILED DESCRIPTION

Figure 1:
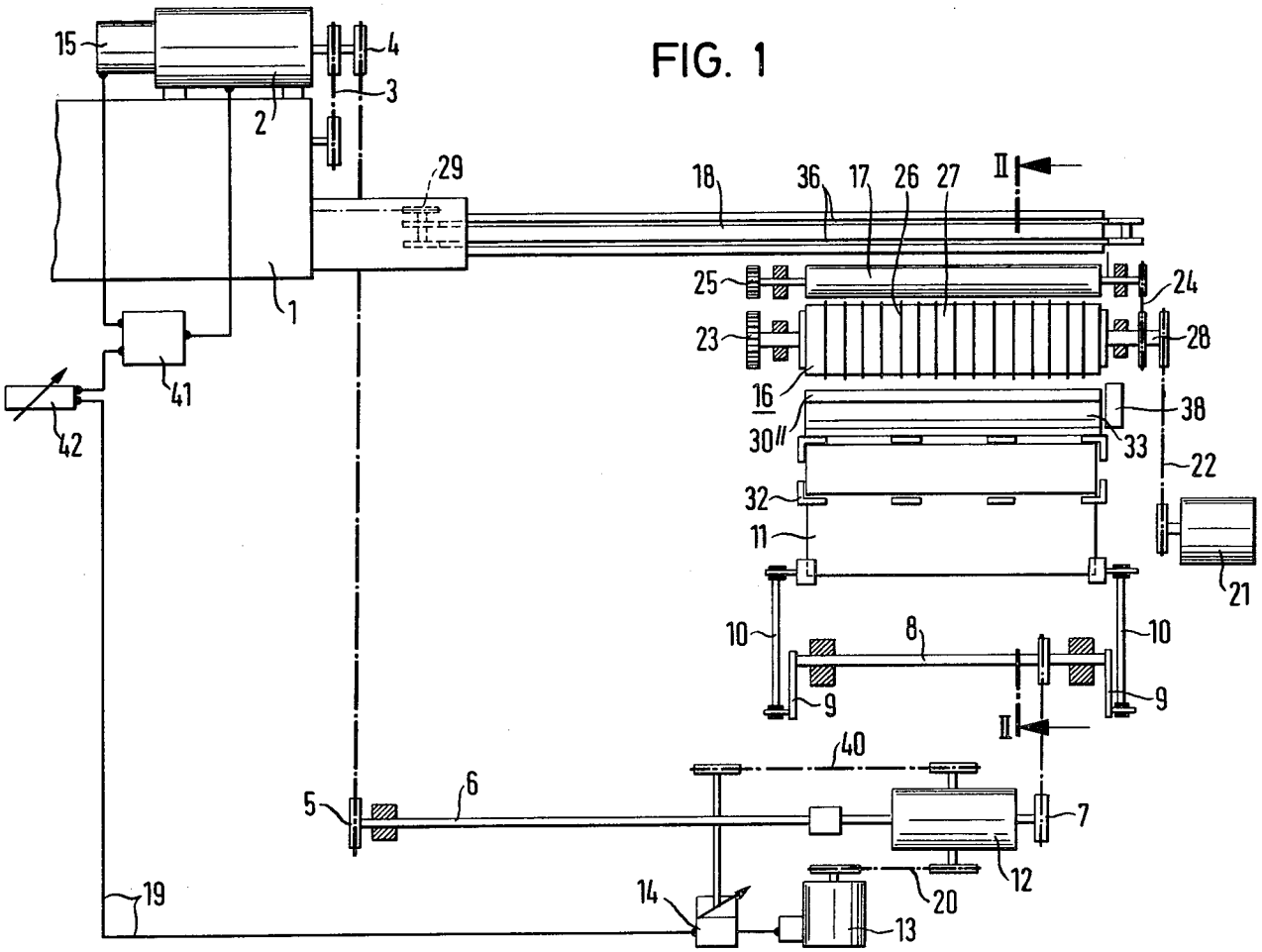
FIG. 1 is a diagrammatic top plan view showing a first embodiment of the apparatus.

The packaging machine 1 is driven from a controllable drive motor 2 via a chain drive 3. A connecting shaft 6 is positively driven from the output shaft of the motor 2 by means of chain sprockets 4 and 5, which are connected by a suitable chain. The transmission ratio between the output shaft of the motor 2 and the shaft 6 corresponds to the number of individual chewing gum sticks into which each chewing gum slab is to be divided. The connecting shaft 6 drives a crankshaft 8 via a chain drive 7. The crankshaft 8 drives an ejecting pusher 11 via the cranks 9 of the crankshaft and the connecting rods 10. The ejecting pusher 11 is reciprocably mounted under a magazine 32, which is filled with chewing gum slabs 30.

The connecting shaft 6 incorporates a differential 12. The drive motor 2 of the packaging machine 1 is provided with a tachometer generator 15, a controller 41 and a speed selector 42. The speed selector 42 is a potentiometer, which has, for instance, a knob for manually adjusting the desired speed of the motor 2. The controller 41 cooperates with the tachometer generator 15 to monitor the speed of the motor 2 and to maintain it at the desired value. The controller 41 compares the desired speed signal generated by the speed selector 42 with the actual speed signal delivered by the tachometer generator 15 and compensates any difference between said signals by a corresponding change of the field voltage applied to the motor 2. The desired speed signal is delivered by the speed selector 42 via a diagrammatically shown lead 19 to an angle-of-rotation signal generator 14, which is connected to an adjusting motor 13. The latter is connected by a chain drive 20 to the differential 12. When the speed of the motor 2 is changed by the speed selector 42, the angle-of-rotation signal generator 14 acts to rotate the adjusting motor 13 in a forward or reverse sense so that the differential 12 is controlled accordingly. By means of a chain 40, the magnitude of the adjustment which has been effected is fed back to the potentiometer of the angle-of-rotation signal generator 14. The latter causes the adjusting motor 13 to be energized until the actual value fed back via the chain 40 equals the desired value applied to the angle-of-rotation signal generator 14.

The ejecting pusher 11 delivers individual chewing gum slabs 30 from the magazine 32 to the gap between cutter rollers 16, which forward the slabs to the gap between feed rollers 17. Each chewing gum slab is then delivered to a feeder 18, which leads to the packaging machine 1.

The cutter rollers 16 are driven at a constant speed via a chain drive 22 by a drive motor 21, which is independent of the operation of the packaging machine. Gears 23 are provided to rotate the upper and lower cutter rollers 16 in mutually opposite senses. The feed rollers 17 are also driven at a constant speed by the drive motor 21 via the chain drive 22, the shaft 28 of the lower cutter roller 16 and another chain drive 24. The upper and lower feed rollers 17 are also operatively connected by gears 25 to rotate in mutually opposite senses. The lower feed roller 17 is rotatably mounted in the machine frame. The upper feed roller is resiliently mounted relative to the lower feed roller 17 so that the chewing gum slabs 30 will be advanced by the feed rollers 17 in frictional contact therewith.

The cutter rollers 16 may consist of circular knives 26 and interposed spacing rings 27, which are axially clamped together on the shaft 28 to form a unit.

The feeder 18 is driven from the packaging machine 1 via a chain drive 29.

Figure 2:
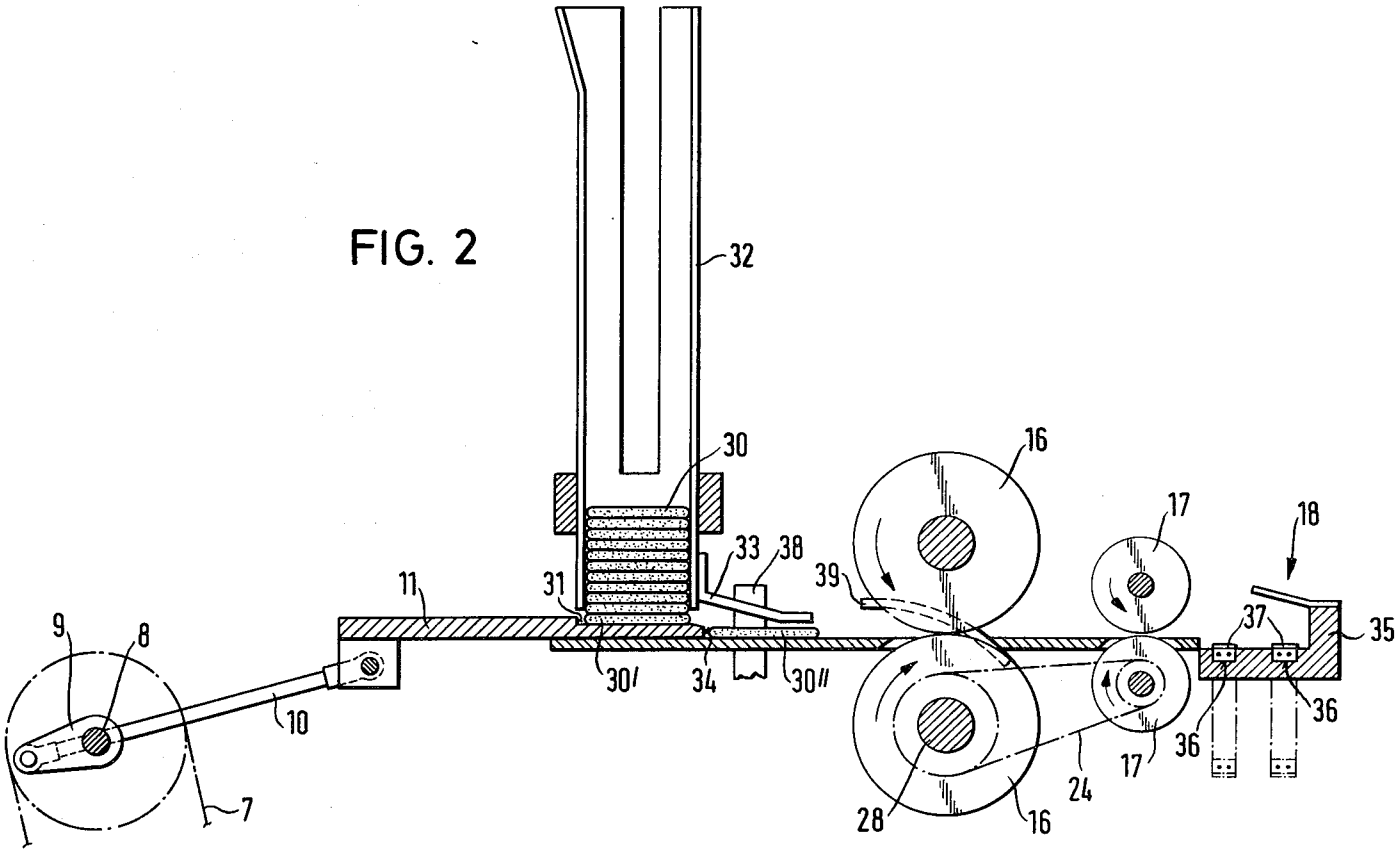
FIG. 2 is a diagrammatic sectional view taken on line II—II in FIG. 1.

FIG. 2 shows the crankshaft 8, the crank 9 and the connecting rod 10 connected to the ejecting pusher 11 in the rearmost position of the latter. The ejecting pusher 11 is a stepped pusher. During each forward stroke of the pusher its step 31 pushes a chewing gum slab 30' from the magazine 32 against the force of a resilient holding-down member 33 to a position 30''. In that position, the chewing gum slabs are transversely aligned by laterally disposed aligning members 38, which are shown in FIG. 1 and are actuated dependently of the speed of the means for driving the ejecting pusher 11. The means for driving these aligning members 38 are not shown. The operation of the aligning members ensures that sufficient material for squaring the chewing gum slabs is provided at both laterally disposed ends of said slab. The slabs are laterally aligned when the ejecting pusher 11 is in its retracted position shown in FIG. 2. During its next forward stroke, the ejecting pusher 11 engages at its forward end edge 34 the chewing gum slab 30'' and advances it into the gap between the cutter rollers 16, which score the chewing gum slabs in preparation for the subsequent division into bars or sticks. The cutter rollers 16 forward the chewing gum slabs to the feed rollers 17, which deliver the chewing gum slabs to a receiving track 35 of the feeder 18. The receiving track 35 has grooves 36, in which the conveyor chains or other conveyor elements 37 of the feeder 18 are slidable.

At the laterally disposed ends of the cutter rollers 16, deflecting blades 39 shown in FIG. 2 are provided on the left and right of the path of travel and serve to break off the protruding end portions of the chewing gum slabs.

By means of the crank drive 8, 9, 10, the ejecting pusher 11 is driven at a varying speed, which is always lower than the peripheral speed or speed of conveyance of the cutter rollers 16 and the feed rollers 17 so that the chewing gum slabs cannot be deformed and cannot accumulate between the ejecting pusher 11 and the cutter rollers 16.

The phase shifting of the drive by means of the differential 12 results in a change of the relative angular position or phase position of the crank 9 so that correspondingly the ejecting pusher 11 will become effective earlier or later whereas the constant reduction ratio between the packaging machine 1 and the ejecting pusher 11 is not changed. This will compensate the differences between the positions which are assumed by the chewing gum slabs on the feeder 18 when the operating speed of the packaging machine is changed whereas the speeds of the cutter rollers 16 and the feed rollers 17 and the speed of travel imparted by them are constant. As a result, the chewing gum slabs will have substantially the same close spacing on the feeder 18 regardless of changes of the speeds or other operating conditions of the packaging machine 1.

Figure 3:
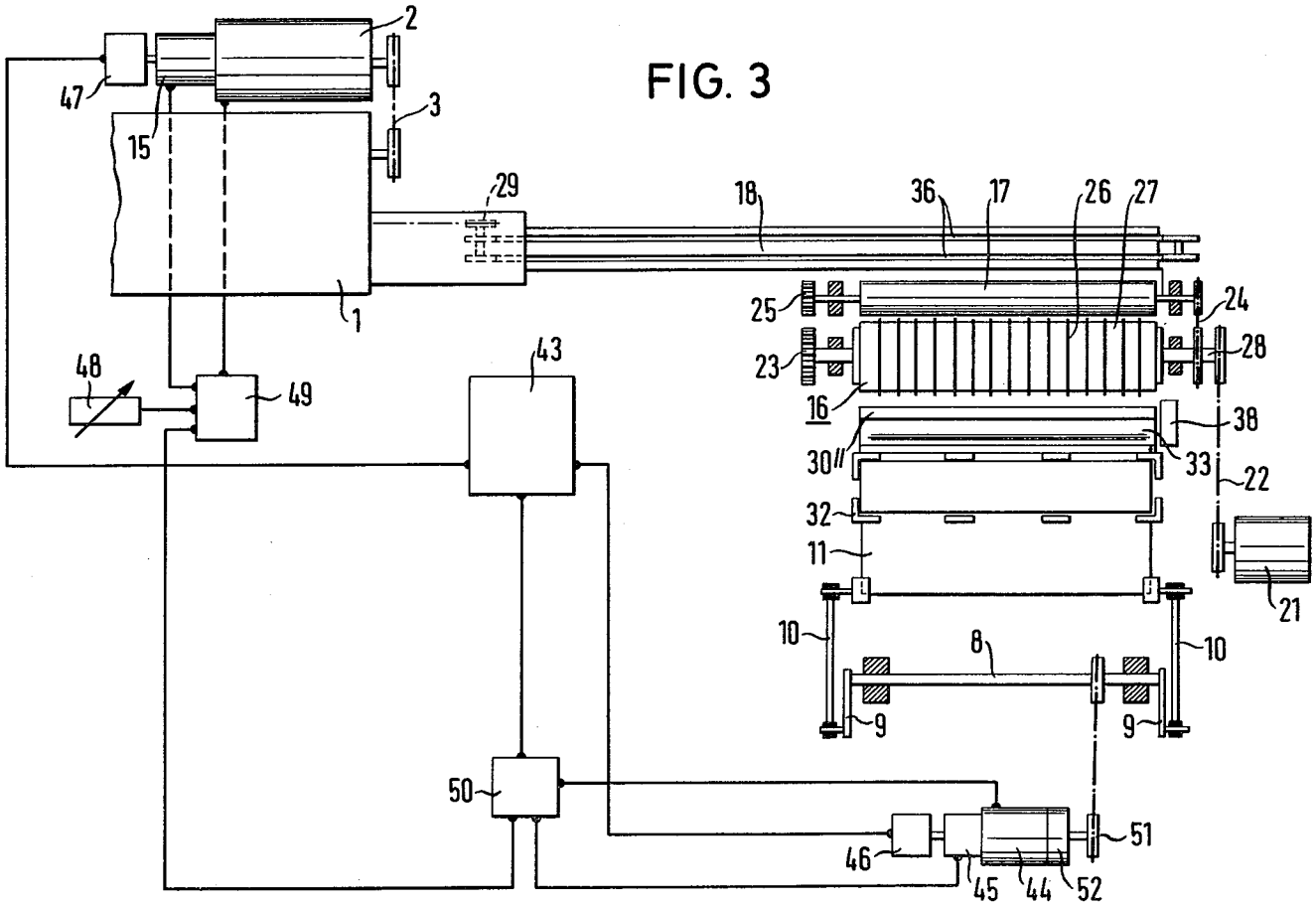
FIG. 3 is a diagrammatic top plan view similar to FIG. 1, but shows apparatus provided with a two-motor drive according to a second embodiment of the invention.

In another embodiment, shown in FIG. 3, the function of the differential 12 and the associated adjusting motor 13 may be replaced and performed by an all-electric control system, which comprises, e.g., a two-motor drive.

In this embodiment, the means for selecting and monitoring the speed of the motor 2 of the packaging machine 1 comprise a speed selector 48, a controller 49 and a tachometer generator 15. By means of the controller 49, another controller 50 and another tachometer generator 45, the speed selector 48 is associated also with a second motor 44, which serves to drive the crank drive 8, 9, 10. Angle-of-rotation signal generators 47 and 46 are associated with the motors 2 and 44, respectively, and together with an angle-of-rotation comparator 43 serve to ascertain the extent to which the motor 44 is shifted in phase by the controller 50.

Such two-motor drives are self-contained systems, which are commercially available although the systems from different manufacturers may differ in design. As long as the motor 2 rotates at a constant speed, such a two-motor drive operates like a so-called electric shaft in that the two motors 2, 44 rotate at the same speed and in phase as though they were interconnected by a mechanical shaft. If the speed of the motor 2 is changed by the speed selector 48, the motor 44 will assume the new speed of the motor 2 but by the angle-of-rotation comparator 43 will be shifted in phase by a certain angle, which is related to the speed change by a function that is fixed in a program that is integrated in the angle-of-rotation comparator 43.

In this way, the required phase shift is imparted via an output sprocket 51 of the motor 44 to the crankshaft 8 and the crank 9 connected to the ejecting pusher 11. That phase shift is enforced in a corresponding manner as by the differential 12 shown in FIG. 1.

A speed-reducing transmission 52 is fixedly attached to the motor 44 and has a transmission ratio that is determined by the number of chewing gum sticks to be obtained from one chewing gum slab.

What is claimed is:

1. Apparatus for supplying chewing gum along a path to the driven feeder of a packaging machine, comprising:

a magazine for chewing gum slabs;

a scoring device having cutting rollers, and said scoring device being juxtaposed with said magazine along said path;

a pushing device associated with said magazine for advancing successive chewing gum slabs along said path from the magazine to the scoring device;

a transfer device including feeding rollers, said transfer device being juxtaposed with said scoring device for forwarding chewing gum slabs which have been scored by said scoring device, to the driven feeder of the packaging machine;

means for driving said pushing device in timed relation to the driven feeder, and including means for shifting the phase of the pushing device relative to the packaging machine depending upon the speed of the packaging machine;

means for driving the feed rollers at a constant/speed independent of the driving rates of said packaging machine and the driven feeder; and means for driving said cutting rollers jointly with said feed rollers.

2. The apparatus of claim 1, further comprising:

a speed selector constructed and arranged to be associated with the packaging machine;

said pushing device driving means including a differential; and control means for linking said differential with said speed selector controlled driving of said pushing device.

3. The apparatus of claim 2, wherein:

said control means includes an adjusting motor drivingly connected to said differential; and an angle-of-rotation signal generator connected between said differential and said speed selector, so that when the speed selector setting is changed the angle-of-rotation signal generator acts to rotate the adjusting motor in a forward or reverse direction to control the differential, while the magnitude of the adjustment being made is fed back to the angle-of-rotation signal generator, causing the adjusting motor to be energized until the magnitude of the feedback signal fed back balances the speed selector setting.

4. The apparatus of claim 1, wherein:

said phase shifting means comprises a first motor for driving the driven feeder of the packaging machine, a second motor for driving the pushing device, speed selector means associated with the first motor, and control means including an angle of rotation comparator operatively connecting the second motor with the first motor so that said second motor rotates at a rate which is related to that of the first motor.

5. The apparatus of anyone of claims 1, 2, 3, or 4, wherein:

said means for driving the pushing device includes a crank drive including a crank and a crankshaft, and said phase shifting means is connected to one of said crank and crankshaft.

* * * * *